US006116292A

United States Patent [19]

Vermeulen

[11] Patent Number: 6,116,292

[45] Date of Patent: Sep. 12, 2000

[54] BOBBIN PALLETS FOR A WEAVING DEVICE

[75] Inventor: Erik Vermeulen, Kortrijk, Belgium

[73] Assignee: N.V. Michel Van de Wiele, Kortrijk/Marke, Belgium

[21] Appl. No.: 08/973,820

[22] PCT Filed: Apr. 16, 1996

[86] PCT No.: PCT/BE97/00045

§ 371 Date: Dec. 9, 1997

§ 102(e) Date: Dec. 9, 1997

[87] PCT Pub. No.: WO97/39171

PCT Pub. Date: Oct. 23, 1997

[30] Foreign Application Priority Data

Apr. 17, 1996 [BE] Belgium ..... 9600336

[51] Int. Cl.[7] ..... B65H 57/00; D02H 1/00; D04B 27/10

[52] U.S. Cl. ..... 139/97; 242/131.1; 242/559; 28/190

[58] Field of Search ..... 139/97; 28/172.1, 28/190; 242/131.1, 128, 130, 559, 594.6, 566, 593, 131

[56] References Cited

U.S. PATENT DOCUMENTS

| | | | |
|---|---|---|---|
| 2,021,032 | 11/1935 | Swanson | 242/131.1 |
| 2,360,558 | 10/1944 | Gebert et al. | 242/131.1 |
| 2,534,579 | 12/1950 | Dennis | 66/125 R |
| 3,172,616 | 3/1965 | Hansen . | |
| 3,432,118 | 3/1969 | Carruthers . | |
| 3,753,274 | 8/1973 | Koslowski | 28/34 |
| 3,773,274 | 11/1973 | Widi | 242/131.1 |
| 3,875,883 | 4/1975 | Eberwein et al. | 242/131.1 |
| 3,905,210 | 9/1975 | McCullough | 66/125 R |
| 4,669,942 | 6/1987 | Nagasawa | 414/331 |
| 5,451,006 | 9/1995 | Smith | 242/131.1 |
| 5,492,152 | 2/1996 | Kikuchi et al. | 139/97 |
| 5,752,549 | 5/1998 | Deruddder et al. | 139/97 |

FOREIGN PATENT DOCUMENTS

| | | |
|---|---|---|
| 545 165 | 2/1956 | Belgium . |
| 0 329 614 | 8/1989 | European Pat. Off. . |
| 0 467 101 A1 | 1/1992 | European Pat. Off. . |
| 2 318 815 | 2/1977 | France . |
| 2 629 840 | 10/1989 | France . |
| 35 38 838 A1 | 5/1986 | Germany . |
| 44 42 231 A1 | 6/1995 | Germany . |

*Primary Examiner*—Andy Falik
*Attorney, Agent, or Firm*—James Creighton Wray; Meera P. Narasimhan

[57] ABSTRACT

A weaving frame or module for supporting warp thread bobbins for a weaving device and for changing bobbins with the weaving modules and bobbin pallets, has bobbins that can, at least partly, be changed without causing any interruption or any disturbance to the warp thread tension in the weaving zone of the weaving device. The frame or module is subdivided into a number of fixed cells for taking individual bobbin pallets each of which has supports for holding a bobbin and for guiding and breaking a thread.

6 Claims, 7 Drawing Sheets

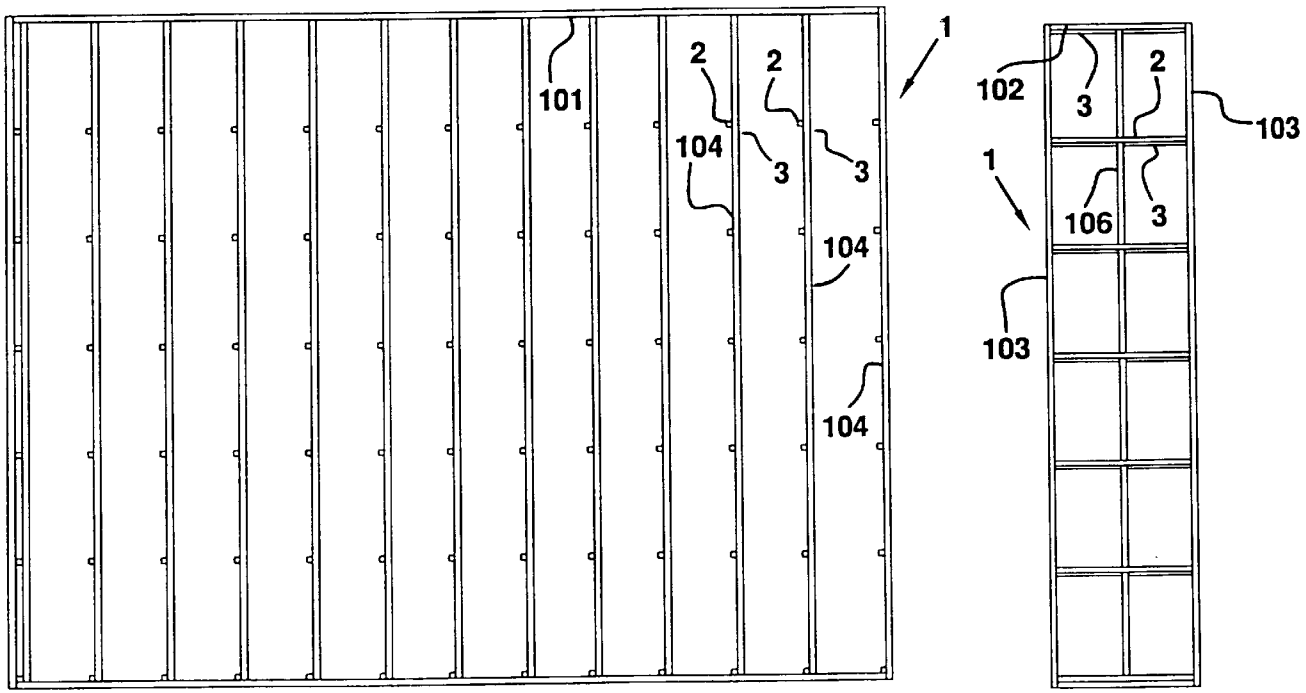
FIG. 1
FIG. 2
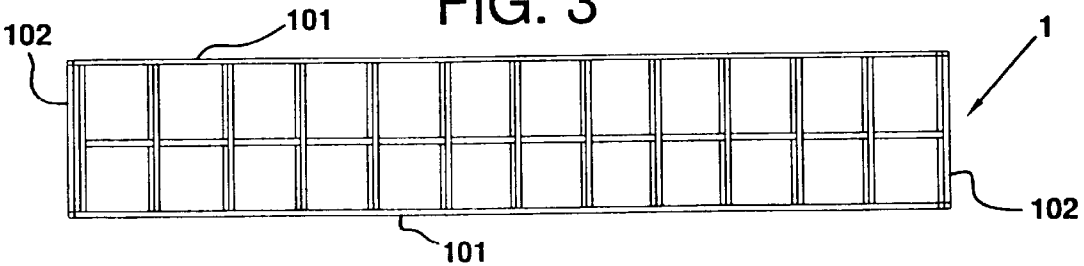
FIG. 3

BOBBIN PALLETS FOR A WEAVING DEVICE

BACKGROUND OF THE INVENTION

This invention relates to a detachable weaving frame that can be at least partly replaced on a continuously operating weaving machine without causing any interruption or any disturbance to the warp thread tension in the weaving zone.

Weaving frames are especially utilized in Jacquard weaving machines whereby each individual warp thread has a different yarn consumption during weaving. These weaving frames are disposed behind Jacquard weaving machines and are suited for carrying a large number of cross-wound spools or bobbins. This number corresponds to the total number of warp threads that are necessary for weaving pattern designs in different colors.

In the course of this text depth direction refers to warp direction, and width direction to weft direction.

In literature on the subject weaving frames are known that consist of a series of doors which extend in the depth direction and of which a number are disposed next to each other in the width direction of the weaving machine. Each weaving frame door is provided on both sides in height and depth with horizontal supporting spindles and thread guiding spindles. The bobbins are usually wound on a cardboard sleeve. This sleeve is placed on a cylindrical plastic sleeve, which is rotatable on the supporting spindle of the weaving frame. The bobbins can also be wound directly onto a plastic sleeve, so that they can be placed on the supporting spindle without additional plastic sleeve. The placing or changing of the bobbins in a weaving frame is carried out by a bobbin loader. For that purpose a passage is provided between each door of a weaving frame. The doors of a weaving frame can also be made rotatable or moveable.

From the bobbins that are placed in the weaving frame, the warp thread is pulled off (unwound) sideways and tangentially over the periphery. The pulled-off warp thread is first passed over a higher reversing guiding spindle located more toward the back and then brought back forward over the higher and forward lying reversing spindle of the forward lying bobbin. The warp threads run forward in the frame, into the throughput reed and the entrance grating, in order finally to come into the weaving zone of the weaving machine.

In order to exert a certain tension on the warp threads a first clamp or trammel is hung over the warp thread loop between the rear reversing guiding spindle and the bobbin in order to slow down the bobbin. A second clamp is hung between the front reversing guiding spindle and bobbin in order to pull back the warp thread out of the weaving zone. These two clamps or trammels that are hung on the warp thread together with the pulled-off loop form a type of band brake over the bobbin and thus establish a certain tension in the warp thread and also prevent the bobbin from unwinding on its own. The front clamp moreover also pulls the warp thread back out of the weaving zone. Hence the terms warp tensioning and pulling-back device of the weaving frame. With the known weaving frames this double function is exerted on and with the bobbin. This warp tensioning and pulling-back device is especially important with pile weaving machines for obtaining a uniform pile height and in order to make possible the interweaving of warp threads, which can take on more than two positions in the weaving shed.

When a Jacquard weaving machine has to be completely changed over to other weaving colors, the weaving machine is stopped in order to take all the bobbins out of the frame manually and in order to place new bobbins in the frame. This operation is labor-intensive and stopping the weaving machine signifies a certain production loss, with the result that the total output of the weaving machine will decrease the more color changes are performed.

Bobbin changes for the maintenance of a weaving frame or for changing certain neighboring pile warp threads can be performed on an operating weaving machine. The bobbin loader must moreover still work cautiously. Firstly both clamps or trammels have to be hung on the respective thread guiding spindle. Then the almost empty bobbin is taken off and the new bobbin is placed on the supporting spindle. A secure knot must be tied in order to connect the old warp thread to the new one and the remaining ends of the knot have to be cut off. Finally the clamps or trammels must be correctly placed and the warp thread must again be brought under tension by a small winding-up of the bobbin by a manual rotating movement. During the whole of the preceding operation the tension of the warp thread should not become too slack in order to avoid the thread keeper from coming into operation and thus interrupting the weaving, process. The tension may also not be too great or the warp thread will no longer fall into the lower position of the shed in the weaving zone so that in-weaving in the fabric becomes impossible and a so-called tension occurs. With pile weave this leads to a pulling closed of the fabric and a hole develops there after cutting through.

The weight of the bobbins that can be placed in a weaving frame is limited by the physical load capacity of the bobbin loader. In practical weaving this weight will not exceed 4 kg.

A device as described in BE no. 9500426 already offers the advantage that clamps or trammels are no longer necessary for maintaining the warp threads under tension and pulling them back out of the weaving zone. This device makes the replacement of a bobbin easier, but during the tying-together the tension on the warp thread between bobbin and recovery/tensioning device remains uncontrolled for a time and there are therefore possible causes of weaving faults. The slowing-down system of the bobbins presented there produces a tension in the warp thread that is dependent on the diameter of the bobbin. Furthermore this device is not suitable for a complete change of the weaving frame or a bobbin change with an automaton because the location of the unwound thread at the top of the bobbin is not set correctly and putting up the sleeve on a spindle requires a very accurate positioning of the bobbin sleeve in relation to the spindle. In the warp thread guiding spindles the various warp threads are not separated from each other. Separation gratings are however provided at certain distances in the weaving frame. But between these separation gratings the warp threads can become entangled with each other.

SUMMARY OF THE INVENTION

The object of this invention is to provide an improved weaving frame or weaving frame module for a weaving device on which the warp thread bobbins can be changed more easily without causing any interruption or any disturbance to the warp thread tension in the weaving zone of a weaving device.

In order to achieve this a weaving frame or weaving frame module is presented as described in the introductory part of the main claim attached hereto, in which each frame or module is subdivided into a number of fixed cells destined for taking individual bobbin pallets each of which comprises means for holding a bobbin and for guiding and braking a thread.

According to a further characteristic of the invention the individual cells can be formed by the divisions which are determined in the frame or module by the supporting means which are provided for the bobbin pallets to be taken in those cells.

Furthermore the cells are preferably provided with means for separating the continuous warp threads from the individual cells, such as for example a reed. These serve to prevent them from becoming entangled with each other. The bobbin is suitably inclined vertically or slight upward, almost horizontally disposed and the warp thread is pulled off axially (unthreaded).

The weaving frame consists of a number of frameworks or doors. Each framework is accessible on both side and comprises supporting means for a number of modules. This framework is disposed independently of and behind the warp thread tensioning and pulling-back device.

According to a distinctive feature of the invention this framework can be disposed fixed or wheeled in widthwise direction. Modules or containers are placed in this framework. Subdivision into modules can e.g. occur upward per pile warp thread in order to enable only one pile warp thread to be changed. Subdivision in depth will take into account the available space of passage behind the weaving frame. Subdivision in width can be per row or per two adjacent rows. Replacement of a bobbin must remain possible on both sides of a door. Taking out and moving a module or container can occur with a roller bridge or another lifting device, the weaving frame can also be made as a transportable unit.

The invention furthermore also provides bobbin pallets specifically developed for such weaving frames and weaving frame modules foreseen for taking one bobbin and equipped with means for guiding and braking a thread, such as preferably a throughput eye and a thread brake.

A bobbin can moreover very suitably be taken in a bobbin pallet with the help of means for supporting and/or means for holding a bobbin sleeve.

According to a first embodiment of the invention the bobbin pallet can comprise a bottom plate in which the means for holding a bobbin sleeve are provided.

This embodiment is in particular very suitable for conical cross-wound spools.

Each bobbin pallet has a bottom plate in which a throughput opening is provided for the bobbin sleeve.

In a particular embodiment this throughput opening comprises an elastic holding device for the sleeve in order to prevent the bobbin from being pulled against the above lying throughput eye with thread brake by the tractive force in the warp thread and the sleeve from being raised out of the bore. A mat of soft foam rubber is placed in each cell. This mat also has a throughput opening adapted to the diameter of the bobbin sleeve. This foam rubber mat takes on the form of the end curvature of the bobbin through which windings are prevented from reaching under the winding body and thus preventing the pulling-off of the warp thread. The bobbins are disposed vertically and the warp threads are pulled off axially (unthreaded).

According to a second embodiment of the invention the bobbin pallet can be equipped with a slightly upwardly inclined horizontal supporting spindle. A sleeve is rotatably attached to this spindle. The bobbin with the winding sleeve is then slid onto this sleeve. When overwinds occur of the bobbin edges then these are pulled onto the winding sleeve and by being rotatable these overwinds can be further unwound without this becoming a tension. A slight inclination is given to the supporting spindle in order to prevent the spool from sliding off the spindle during transport of the pallet or during weaving. The warp threads in this embodiment are therefore pulled off (unwound) tangentially.

This embodiment is in particular very suitable for cylindrical cross-wound spools. Through this embodiment possible problems are avoided which could occur when a cylindrical cross-wound spool body shows overwinds on the edges. With the first embodiment of the invention in such a situation the yarn could be pulled between the spool body and the bottom plate of the bobbin pallet through which the bobbin could finally nevertheless be raised out of the pallet bore. This phenomenon can also occur with conical cross-wound spool bobbins which may show overwinds on the spool edge with the largest diameter.

In the axis of the bobbin on top in the bobbin packet a throughput eye with thread brake is disposed attached to the frame on the bobbin packet. Each cell is further provided with a reed for holding up and separating the continuous warp threads from other cells through which the warp threads are prevented from entangling with each other.

A finished bobbin can easily be manually replaced in such a cell. The bobbin sleeve is raised out of its holder opening with clip device and taken out of the cell. The warp thread carries on running through the fixed throughput eye with thread brake. The warp thread that runs to the front of the frame to the weaving zone remains under tension and is not disturbed if the end that runs from the throughput eye to the bobbin is held slack. In this slack end the thread from the empty bobbin can be cut off and a new bobbin can be tied on. The new bobbin is then placed with the sleeve in the opening and clip device of the cell bottom.

The advantages of such a device are obvious. A bobbin can be replaced without disturbance to the warp thread tension on an operating weaving machine in a shorter time. The warp threads will be less entangled with each other and therefore cause fewer tensions. With a pile weaving machine the pile height will therefore be more uniform. A pile warp thread can quickly be completely changed with an idle machine by removing a number of modules or pallets and replacing them with externally prepared new modules. Finally a complete frame can be changed with an idle weaving machine by replacing all modules with new externally prepared modules. The time necessary for a color change is greatly reduced and the total weaving output of the installation will increase.

Color changes will also be able to be carried out more frequently while maintaining a considerable total output. The weaving mill will therefore be more flexible for following the demand for color changes. Furthermore shorter running lengths can be efficiently performed in a specific color combination.

For bobbins with a length that is greater than the diameter, the vertical disposition of the bobbins will cause the total height of the frame to increase. But upward there is now sufficient space since that height is just available for the Jacquard device with superstructure. The bobbin diameter will now determine the width of a door. With an equal number of doors, the width of the frame will be smaller which is convenient for the angle of entry in width direction of the warp threads into the weaving machine.

Existing weaving frames are not particularly suitable for bobbin changing with an automaton. In order to place a bobbin with sleeve on a horizontal spindle the adjustment of the bobbin in relation to the spindle must be rather accurate and the spindles have to be at a precise distance from each other. The weights in the form of clamps or trammels on the pulled-off warp thread are a hinderance for easy replacement of a bobbin. Furthermore the location of the pulled-off warp thread in function of the unwinding cannot be correctly determined. Because of this the gripping of the finished warp thread above the bobbin by an automaton is rather complicated. During the bobbin changing the warp thread must be able to be further pulled off so that the weaving process can continue undisturbed. This means that the bobbin cannot be gripped at the sleeve, unless a certain rotating movement is permitted during the manipulation. This is of course a complication. The new bobbin must be presented with the warp thread beginning which must be easily accessible for a gripper. Existing weaving frames offer no solution for these problems.

A further object of the invention is to provide a weaving frame whereby each individual bobbin can be replaced by an automaton both on an idle and on an operating weaving machine.

In order to achieve this task a number of difficulties that arise with existing weaving frames must be resolved. The warp thread tensioning and recovery device must be made free of the bobbin; the bobbin must be able to be placed on the weaving frame by a device whereby no mm positioning accuracy is required, the location of the finished warp thread must be well determined; while bobbin changing the warp thread from the bobbin to be removed must be able to be further pulled off; the beginning thread end of the new bobbin to be mounted must be localized in order to be able to grip this with an automaton.

In order to resolve these difficulties according to the invention the warp thread tensioning and pulling-back device is placed independently from and in front of the weaving frame. The weaving frame itself consists of fixed or moveable frameworks or doors which are accessible on both sides. In this framework a number of cells are provide with fixed thread guiding reeds. In these cells changeable pallets are placed. These pallets are provide with means for clamping and wedging a bobbin. A pallet changing automaton is provided with means for transporting and changing the pallets, for bringing yarn ends together and for tying or splicing these together. The pallet changing automaton will be carried by a three-dimensional positioning robot so that each cell of the weaving frame and a number of cells of the loading and removal station for reception and removal of pallets are accessible for running with a program.

The invention finally also relates to a method for changing warp thread bobbins in a weaving frame or weaving frame module of a weaving device, without causing any interruption or any disturbance to the warp thread tension in the weaving zone.

According to this method the above described weaving frames or weaving frame modules and bobbin pallets are used, whereby while changing bobbins the warp thread of the bobbin pallet to be replaced is made to hang slack, is cut off and tied to the thread ends of the replacing bobbin pallets, after which the bobbin pallet is changed over and the replacing bobbin pallet is placed in the cell in question. Very suitable use can moreover be made of a pallet changing automaton which is provided for transporting and changing the interchangeable bobbin pallet, for bring the thread ends together and for knotting or splicing these together. The pallet changing automaton can moreover be very suitably carried by a positioning robot and be operated by a computer that regulates the changing of the bobbin pallets in function of the diameter of the bobbins disposed on individual bobbin pallets in the weaving frame or the weaving frame modules, measured with the assistance of a measuring system controlled by the computer, and in function of the pattern of the Jacquard fabric to be woven and the theoretical thread consumption for that purpose.

These and other characteristics and distinctive features of the invention will ensue from the following description in which reference is made to the attached drawings which show an embodiment of a weaving frame and pallet according to the invention

BRIEF DESCRIPTION OF THE DRAWINGS

In these drawings:

FIG. 1 is a side view of a weaving frame for detachable bobbin pallets according to the invention;

FIG. 2 is a front view of the weaving frame shown in FIG. 1;

FIG. 3 is a top view of the weaving frame shown in FIGS. 1 and 2;

DETAILED DESCRIPTION OF THE PREFERRED EMBODIMENT

Figure 4:
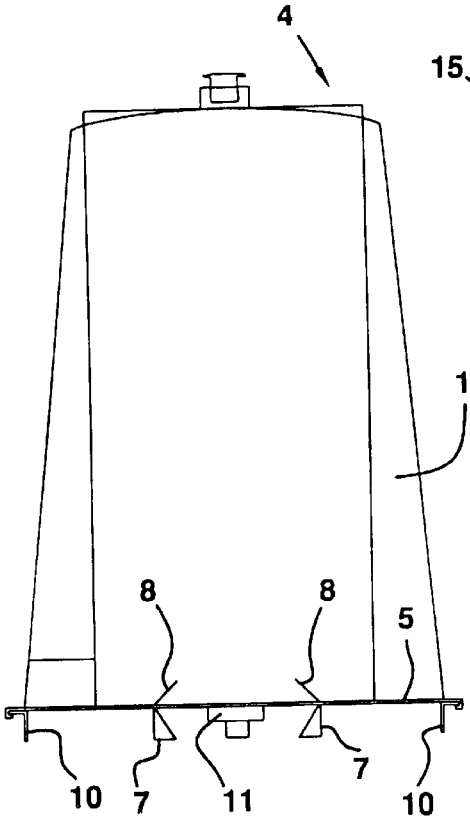
FIG. 4 is a side view of a first embodiment of a bobbin pallet according to the invention.
Figure 5:
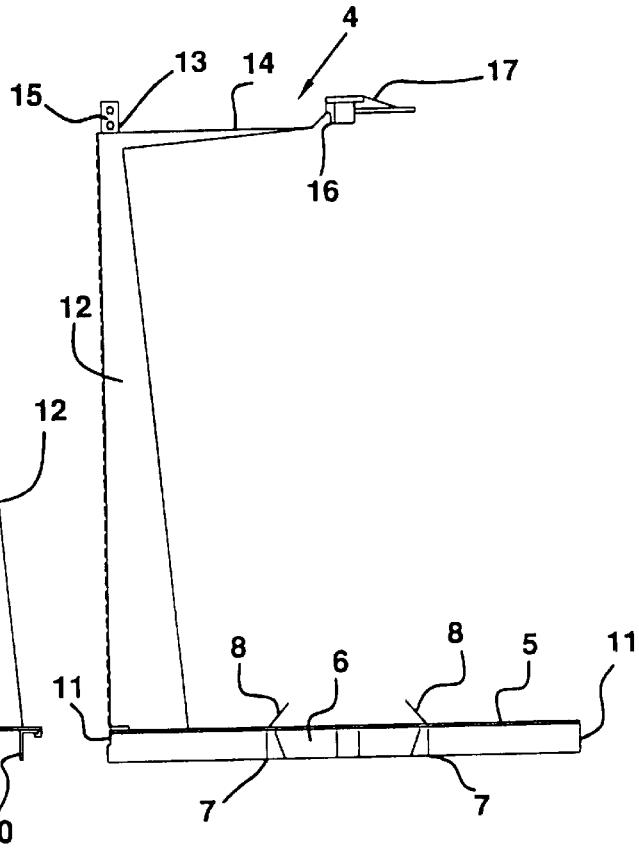
FIG. 5 is a front view of the pallet shown in FIG. 4.
Figure 6:
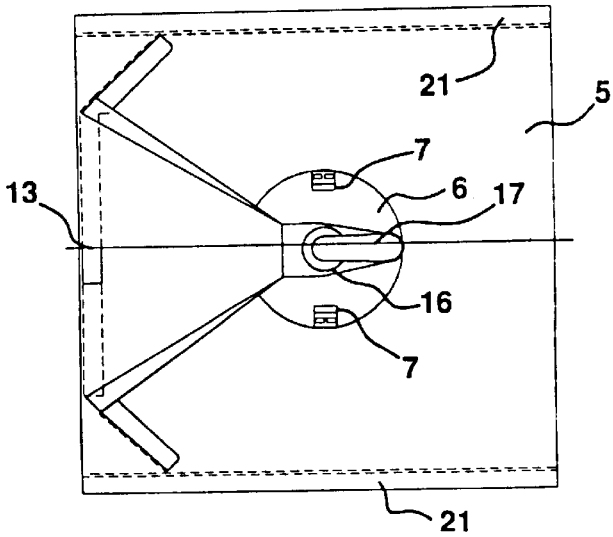
FIG. 6 is a top view of the pallet shown in FIGS. 4 and 5.

In these drawings the same reference signs indicate the same or similar elements.

As presented in FIGS. 1–3, each weaving frame consists of a number of doors 1 which extend in warp direction and of which a number are disposed next to each other with a space in width direction. Each door is accessible on both sides because of the fact that these are placed at a certain distance from each other in width direction in order to provide passage to a pallet changing automaton. Each door consists of an external framework, consisting of horizontal frame staves 101, 102 and vertical frame staves 103, with central supporting staves 104 for supporting means of carrying arms 2 which extend horizontally like "antennas" from those central supporting staves 104 (forward and backward in relation to FIG. 1). The carrying arms 2 are at a specific height and depth from each other. The distance between carrying arms in height and in depth determines a cell. Each cell is provided with a warp thread reed 3, which is placed just under a carrying arm so that this carrying arm forms the top of the reed.

Figure 7:
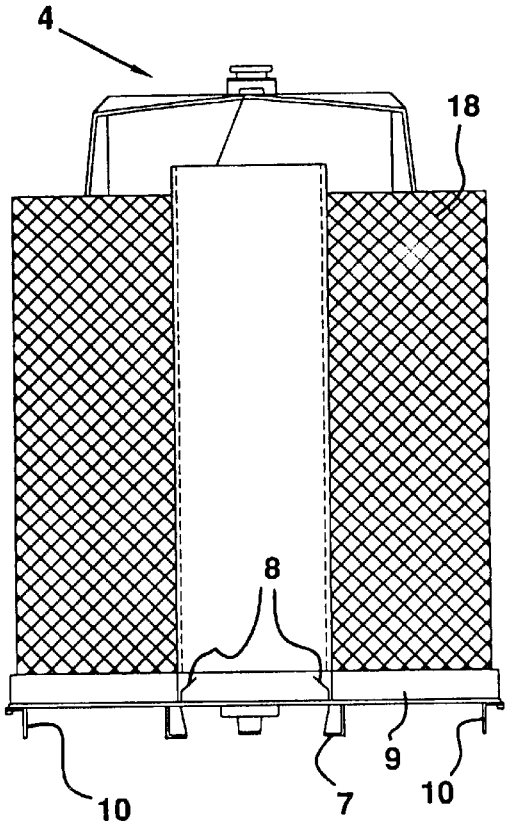
FIGS. 7–9 are views-that correspond to FIGS. 4–6 of a bobbin disposed on a pallet as shown in these figures.
Figure 8:
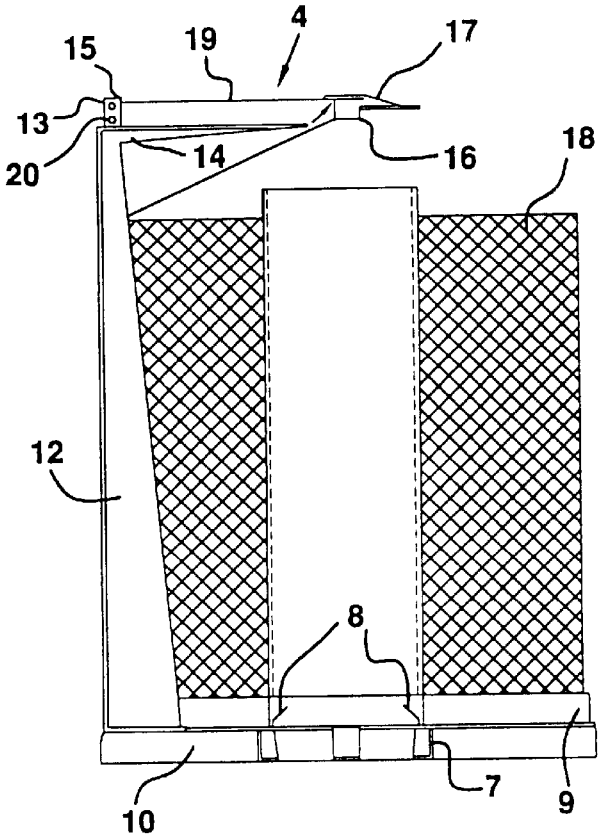
Figure 9:
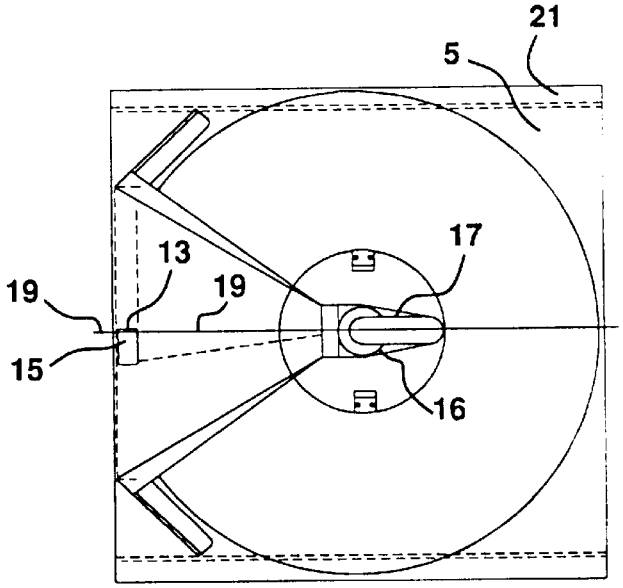

The bobbins are placed vertically on pallets 4 (FIGS. 7–9). Such a pallet is made of steel plate, aluminum, plastic or wood. Each pallet has a hole 6 in the bottom 5 for passage of a bobbin sleeve. Means are provided in that opening for clamping a bobbin sleeve. These means are e.g. stop surfaces 7 provided with leaf springs 8 which clamp onto the inside of the sleeve. Because of this the bobbin is prevented from rising up through the tractive force in the warp thread. A foam rubber mat 9 is placed on the bottom of the pallet. This foam rubber mat 9 takes on the form of the end curvature of the bobbin. With this windings are prevented from falling under the winding body 18 of the bobbin and thus preventing pulling-off.

The pallet furthermore has two pallet carrying profiles 10 on the side, which serve for putting it on the carrying arms 2 of the weaving frame or for being able to place the pallet on a roller conveyor belt. Two bulges 21 are provided in the pallet carrying profiles 10. These bulges fit into bores that are applied in the carrying arms 2 of the weaving frame and in so doing form a stop in order to prevent the pallets from sliding off the carrying arms. The bottom of the pallet has a bumper 11 at the front and back. This bumper serves for moving the pallet onto a roller conveyor belt by pushing along. Each pallet has a holder 12 that is attached permanently or by clipping onto a side of the bottom of the pallet.

On top the holder 12 has a vertical projection 13 and a horizontal part 14. The projection 13 supports a thread clip 15. The horizontal part 14 supports a throughput eye 16 with thread brake 17. This throughput eye 16 lies in the axis of the bobbin. The thread clip 15 consists of a leaf spring with bore 20 for a stop pin and a slot, for attachment of a thread end against the support 13 (FIGS. 7–9). The throughput eye 16 is e.g. a porcelain eye. On the upper surface of the eye a leaf spring with pressure ring 17 is installed for slowing down the warp thread. The warp thread can therefore be pulled off in all directions. The holder 12 has a vertically extending part 13 and the thread clip is attached to the top of this part. The horizontal part 14 of holder 12 lies under the level of the thread clip 15 and the other extremity has an upward bending so that the throughput eye 16 comes back to the level of the thread clip 15 (FIGS. 7–9).

The cross-wound spool or bobbin with the sleeve is put vertically through the opening in the foam rubber mat 9 and in the pallet bottom (FIGS. 7–9). The winding body 18 rests on the foam rubber mat 9 and the sleeve is held in the bottom clips 8. The beginning thread end 19 of the bobbin is brought through the throughput eye 16, under the thread brake 17 and the extremity of the thread 19 is pulled into the thread clip 15, so that the thread 19 comes to lie stretched between thread clip 15 and throughput eye 16. In this manner the location of the beginning thread end of the bobbin is correctly set.

The variant of the bobbin pallets according to a second embodiment of the invention shown in FIGS. 17–20 for the greater part comprises analogue parts which are indicated by the same reference numbers in the drawings.

According to this second embodiment of the invention the bobbin pallet is equipped with a slightly upwardly inclined horizontal supporting spindle. A sleeve 41 is rotatably attached to this spindle 40. The bobbin 18 with the winding sleeve 42 is then slid onto this sleeve 41. When overwinds occur on the bobbin edges these are then pulled onto the winding sleeve and by being rotatable these overwinds can be further unwound without a tension occurring. A slight inclination is given to the supporting spindle in order to prevent the spool from sliding off the spindle during transport of the pallet or during weaving.

The warp threads are therefore pulled off (unwound) tangentially.

Figure 10:
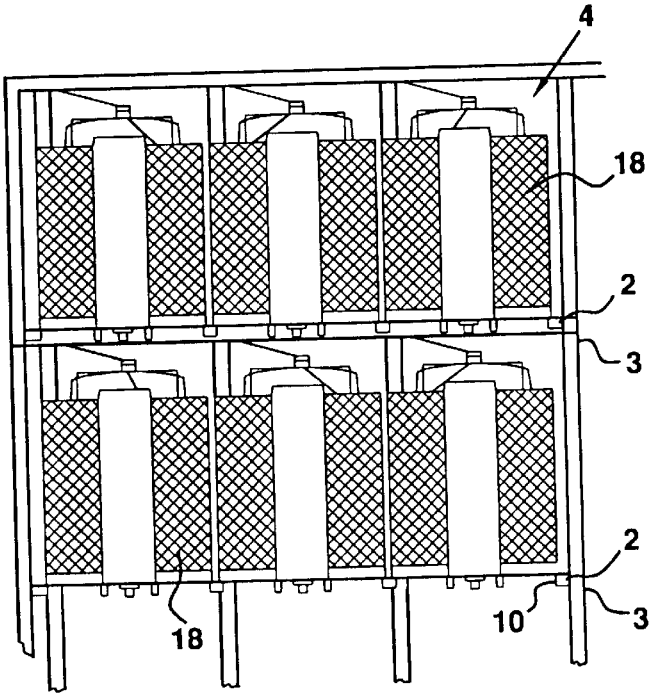
FIGS. 10–12 are views of a part of the weaving frame shown in FIGS. 1–3 and provided with bobbin pallets and bobbins.
Figure 11:
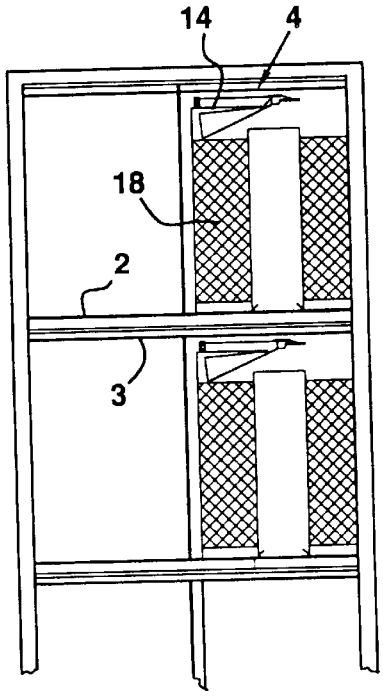
Figure 12:
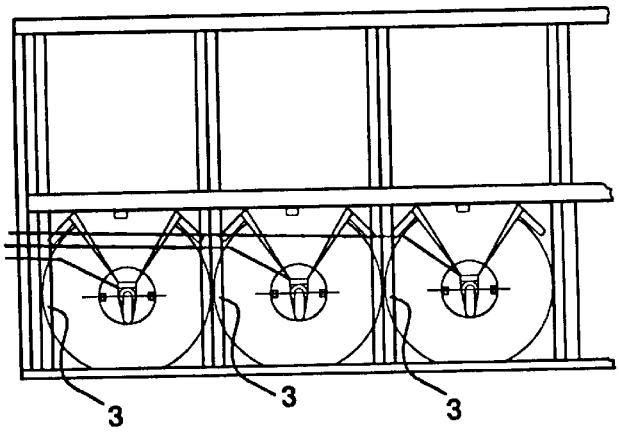

The pallets rest with the pallet carrying profiles 10 on the carrying arms 2 of the weaving frame (FIG. 10). From a pallet that is in the weaving frame the warp thread is pulled off through the throughput eye 16 with thread brake over a warp thread reed 3 fixedly attached to the frame. When a pallet is slid out of the frame in width direction, the warp thread still keeps running out, from the fixed thread reed 3 up to the actual position of the throughput eye 16 at the top of the pallet. The location of the warp thread end of the finished bobbin is well-determined because of this.

There is a certain play between the carrying arms 2 and the pallet carrying profiles 10. The positioning of the pallet in relation to the weaving frame therefore does not need to be so accurate in depth direction of the frame. In width direction the pallet must be slid sufficiently far over a stop. This stop must prevent the pallet from sliding out of the frame.

In height direction the pallet has to be raised sufficiently high in order to be able to slide in or out over the stop. With this the problem of accurate positioning is completely solved.

The system for bobbin changing with automaton comprises a pallet preparation system with storage of the prepared pallets in waiting ranks, a loading and removal station for the pallets, a transport system for transporting the prepared pallets, which are placed in waiting ranks, to the cells in the weaving frame and vice versa, a pallet changing automaton 22 which removes the old, almost empty pallet and replaces this with a new one, and a tying-on automaton or splicer for connecting the old and new bobbin.

In a pallet preparation system or palletizing station the bobbins are removed from the supply packaging and in each case placed on a pallet according to the invention. Here the thread beginning end 19 is sought and this thread end is pulled through the throughput eye 16 with thread brake 17 up to the thread clip 15 so that the thread is stretched between thread clip 15 and throughput eye 16. The pallets are then placed in a waiting rank per color of the bobbins placed thereon. This palletization operation can occur manually or with an automaton.

An x,y,z gantry robot or overhead travelling robot is for example employed as transport device. This robot is provided with a pallet changing automaton 22 with a tying-on or splicer automaton. The robot goes according to an operating program to get a pallet with a bobbin of a certain color from the waiting rank of the color in question in a loading station in order to take a pallet with full bobbin in the part of the pallet changing automaton 22 provided for that purpose. The robot brings this pallet changing automaton 22 to the cell in the weaving frame where a bobbin is to be replaced.

Figure 13:
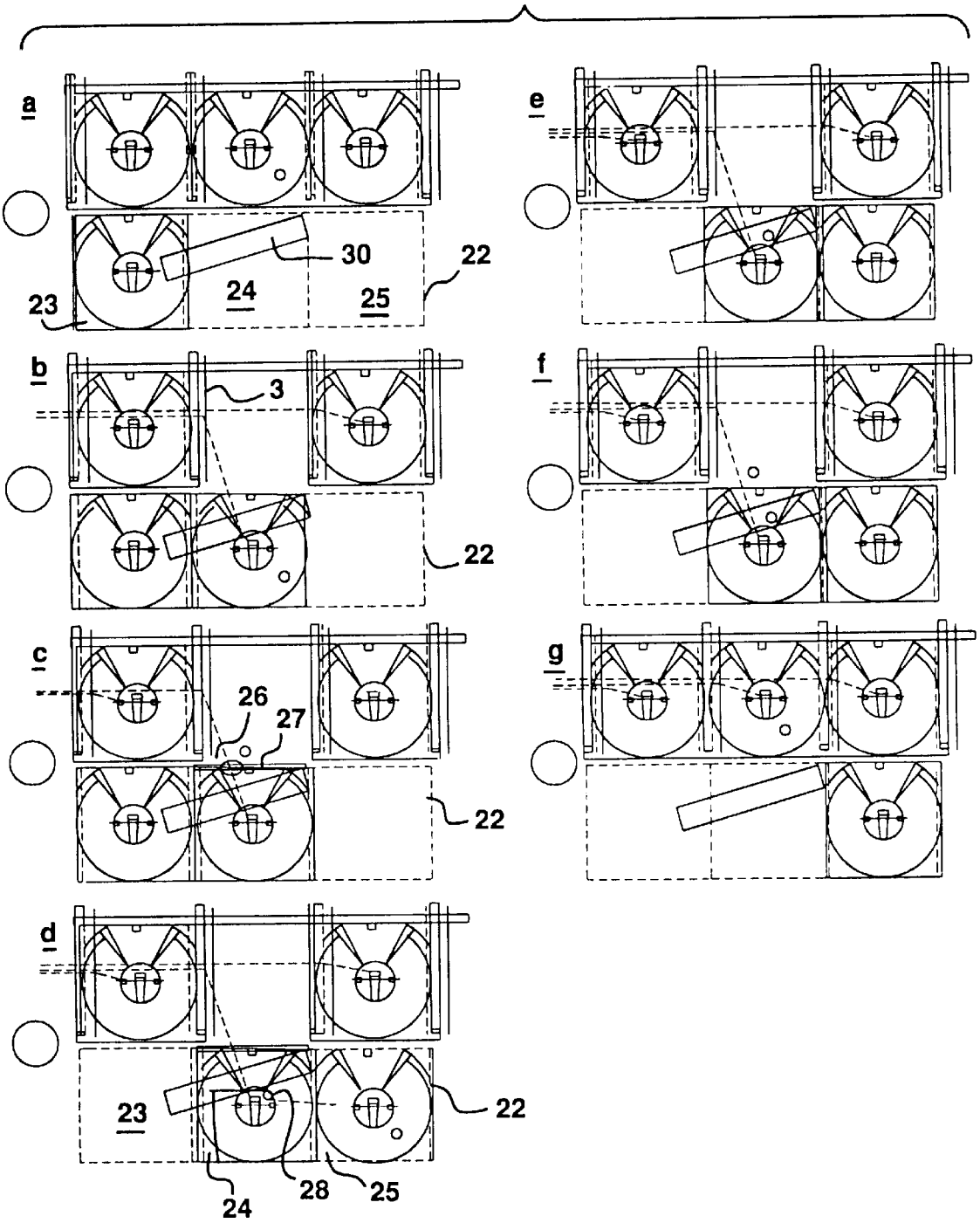
FIGS. 13*a*)–13*g*) are partial top views of the weaving frame according to the invention during the course of the various steps of bobbin changing with the assistance of a pallet changing automaton.
Figure 15:
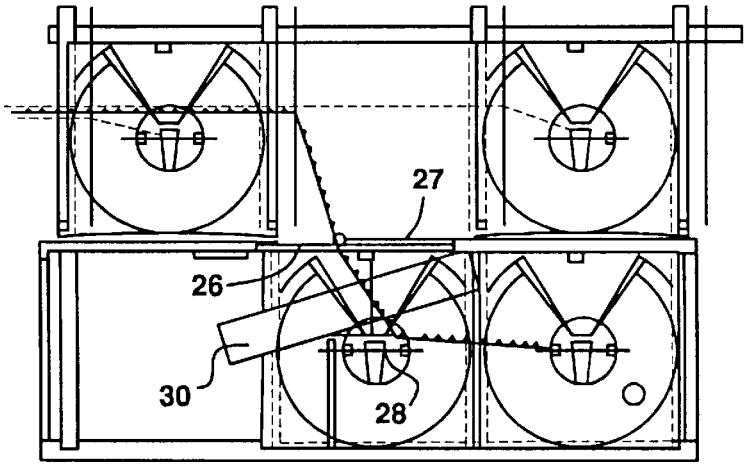
FIG. 15 is a top view on a larger scale of FIG. 13*d*)

As shown in FIGS. 13 and 15 the pallet changing automaton 22 consists of three parts:

- a part 23 with a filled pallet,
- a changing part 24 and
- a part 25 into which the almost empty pallet from the weaving frame will come.

The pallet changing automaton is now brought by the robot control with the changing part 24 right in front of the cell of the bobbin to be replaced (FIG. 13*a*). The pallet changing automaton slides the pallet with the almost empty bobbin in width direction out of the weaving frame into the changing part (FIG. 13*b*). The weaving machine can hereby continue to operate. The warp thread can be pulled off further from the bobbin, because the warp thread hereby continues to run from the fixed thread reed 3 to the throughput eye 16 with thread brake 17 up to the bobbin.

Figure 16:
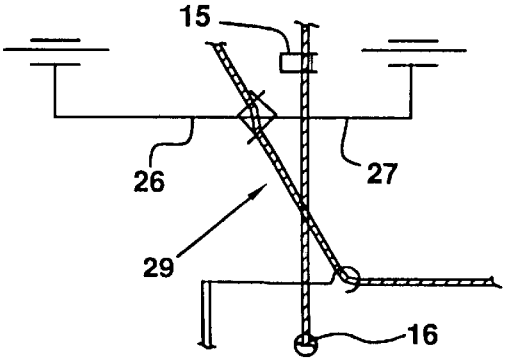
FIG. 16 is a schematic representation, in top view of the knotting of the threads while changing the bobbin pallets.
Figure 17:
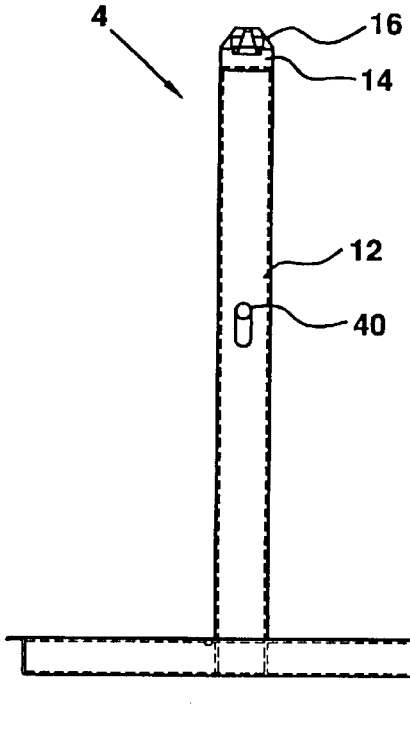
FIG. 17 is a side view of a second embodiment of a bobbin pallet according to the invention.
Figure 18:
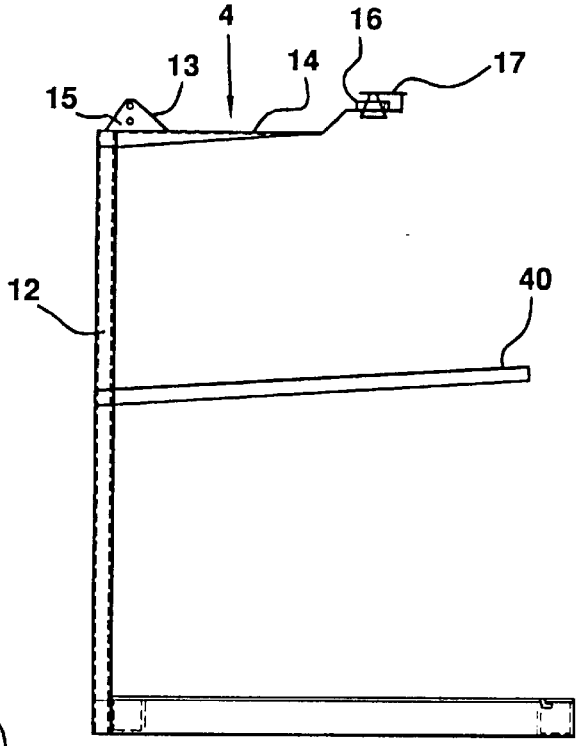
FIG. 18 is a front view of the pallet shown in FIG. 17.
Figure 19:
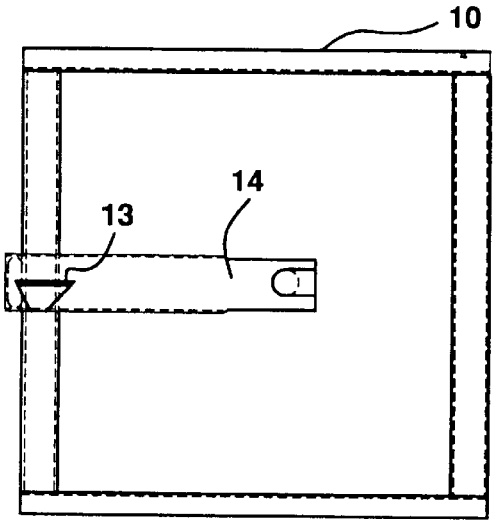
FIG. 19 is a top view of the pallet shown in FIG. 18.
Figure 20:
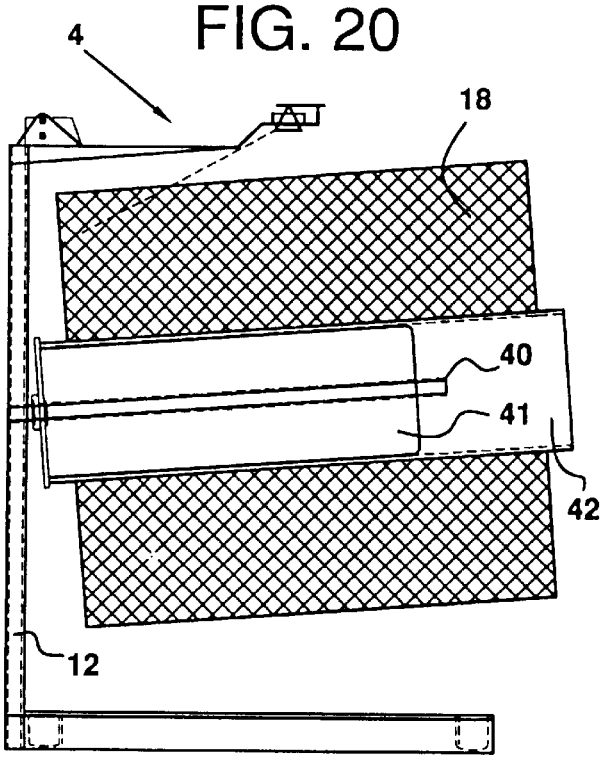
FIG. 20 is a view corresponding to FIG. 17 of a bobbin disposed on a pallet as shown in that figure.

Two moveable hooks 26 and 27 move toward each other and bring the warp thread still pulled off through the weaving process into a specific position (FIGS. 13*c*, 15 and 16). The pallet changing automaton now moves the almost empty pallet into the vacant part 25 and the full pallet 23 into the changing part 24. This movement is performed horizontally in depth direction until the new full pallet comes to stand right in front of the cell (FIG. 13*d*). With this movement the warp thread of the almost empty bobbin is further pulled off since the warp thread still remains connected. The warp thread is also pulled into a third hook 28 through this movement. This hook 28 is fixedly connected to the pallet changing automaton and hooks in onto the thread end just next to the throughput eye in the horizontally stretched warp thread zone between throughput eye and thread clip device.

Figure 14:
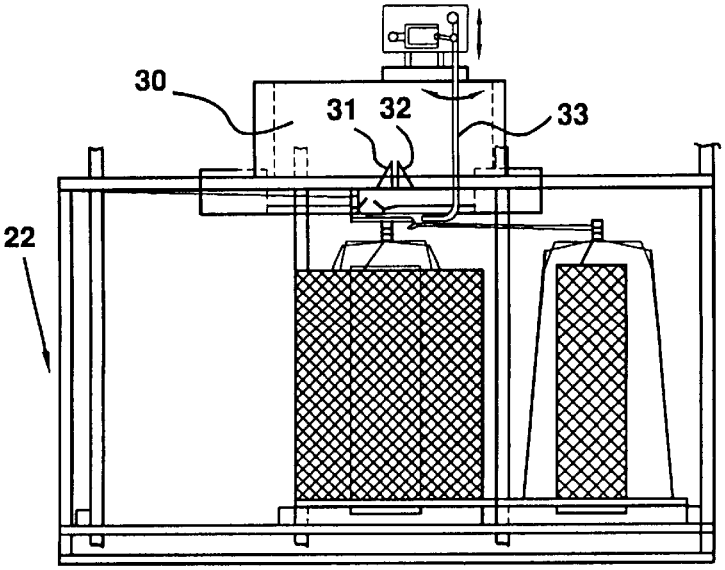
FIG. 14 is a side view on a larger scale of the pallet changing automaton as shown in FIGS. 13*a*)–13*g*)

The pulled-off warp thread is positioned between the hooks 26, 27 and 28 and forms a first arm of the cross form 29 (FIG. 16). From the new pallet with full bobbin the thread beginning is well localized namely from the thread clip 15 up to the throughput eye 16 above the bobbin. This is to make the second arm of the cross form 29 under the insertion groove of the splicer 30 (FIGS. 14 and 15). The cross form 29 serves for presenting both warp threads to be attached in the respective groove 31 and 32 of the splicer 30 or tying-on apparatus (FIG. 14).

In order to provide for a warp thread consumption during the subsequent tying-on operation, the robot can still perform an extra horizontal movement in depth direction, so that the warp thread is still pulled off a little more and that can be interwoven during the tying-on operation, whereby the robot then performs a gradual return movement.

Two rotatable and vertically moveable hooks 33 are attached on both sides of the splicer 30 (FIGS. 14–16). The hooks 33 swivel under the cross of the warp threads and pull the cross form of both warp threads together upward in a vertical movement until the cross comes to lie in the respective grooves 31 and 32 of the splicer or the tying-on apparatus. This splicer or tying-on apparatus is attached at the top of the pallet changer (FIG. 13*e*).

The splicer 30 or tying-on apparatus carries out the attachment and cuts off the thread of the empty bobbin and the thread of the new bobbin to the thread clip 15. This remaining end remains hanging in the thread clip of the new pallet but this does not cause any interference at all (FIG. 13*f*). The warp thread which is now interwoven runs from the fixed thread reed in the weaving frame to the throughput eye with thread brake of the new pallet. The new pallet is now slid into the frame by the pallet changing automaton (FIG. 13*g*). With this the bobbin changing is complete.

The pallet with almost empty bobbin is now brought by the robot to a pallet removal station. The remaining thread will hereby not further unwind during the transport because the end is still in the thread brake 17 of the throughput eye 16. The pallet removal station will preferably be next to the waiting rank of the newly prepared pallets. In this manner positioning only has to take place once and the unloading and loading operation can take place at the same time. There will be a specific place of loading, and removal station for each color of the warp thread.

The pallet changing automaton can also be provided with a stack for newly prepared pallets and a stack for empty old pallets. The stack for newly prepared pallets will connect to the part for a full new pallet and the stack for empty pallets will connect to the part for the empty pallet. Because of this extension the robot can work more efficiently because of the fact that fewer movement routes from and to the loading and removal station have to be made.

In order to be able to serve both a left and right side of a passage between two weaving frame doors the pallet changing automaton will be equipped with a left and right part each with its own tying-on automaton or splicer. Of course only one part, either the left part of the right part will be operational.

In order to determine when a bobbin needs to be changed, the robot is equipped with a measuring system for measuring the diameter of the bobbins disposed in the frame on the pallets. The robot can according to a determined program go and measure all rows in a specific door and these measurement data are stored in the memory of a weaving frame control computer. If a minimum diameter is measured for a bobbin then a signal is given for replacement of the pallet on that specific cell. The control computer can determine which color must be replaced from the bobbin loader plan that is also stored in the computer. Such a unit can therefore work alone.

The controller of an electronic Jacquard machine knows the pattern to be woven. This controller is connected to the control computer in a network. The Jacquard controller periodically sends the theoretical thread consumption of the already woven length through to the control computer. The weaving frame control computer takes this into account in determining the measurement program for measuring the bobbin diameters and with this predicts when a bobbin will finish in the weaving frame. Thus bobbin pallets can be replaced just before finishing without causing any interruption in the weaving process and whereby the waste in remaining yarns is avoided.

The device also fills an empty frame with newly prepared bobbin pallets in the case of a first start-up of an installation. For this purpose it is sufficient to provide a program whereby no "old" pallets need to be removed from the weaving frame. The threading through the reeds and the thread tensioning device has to be done manually. After filling up the whole weaving frame it is then switched over to the maintenance program of the weaving frame. A program also has to be provided for the systematic replacement of a pile warp thread or of the whole weaving frame for switching over to other colors.

The advantages of such a device are clear: bobbin changing becomes less labor-intensive and can be performed according to thread consumption and bobbin measurement, standing idle for and caused by bobbin changing is greatly decreased, bobbin changing is carried out without causing any disturbance to the warp thread tension, through which fewer idle times of the weaving machine occur through temporarily slack warp threads. Because of the fact that each cell comprises a guiding reed, the warp threads will become less entangled and thus cause less tensions. The weaving machine will also stand idle for less time for a partial or full color change. By entrusting the weaving frame control to a computer that is linked to the robot with bobbin changing automaton further color variations can be introduced into every pile warp thread in the form of lattice colors. The computer now controls every bobbin pallet individually and this can also be controlled according to a color scheme program. In this manner the fabric can therefore be designed with more colors without running the danger that the color control becomes no longer controllable.

This weaving frame can of course also be placed behind a beam machine in order to function as a beam frame. The same method for changing bobbins can be applied.

What is claimed is:

1. Bobbin pallets for a weaving device to facilitate changing of bobbins without interruption or disturbance to warp thread tension in weaving zones of weaving devices comprising plural cells, an individual bobbin pallet in each cell, each bobbin pallet comprising support means for supporting and/or holding one bobbin sleeve, one throughput eye for guiding a thread, and one thread brake.

2. The bobbin pallet of claim 1, wherein the pallet further comprises a bottom plate for holding the support means.

3. The bobbin pallet of claim 2, further comprising a mat of soft foam rubber on the bottom plate, wherein a throughput opening is adapted to a diameter of the bobbin sleeve.

4. The bobbin pallet of claim 1, further comprising two pallet carrying profiles for being received on carrying means of a weaving frame cell and/or for positioning the pallet on a roller conveyor belt.

5. Bobbin pallets for a weaving device for facilitating changing of bobbins without interruption or disturbance to warp thread tension in weaving zones of the weaving device, each bobbin pallet comprising support means for supporting and/or holding one bobbin sleeve, one throughput eye for guiding a thread, and one thread brake, wherein the support means comprises a slightly upwardly inclined horizontal supporting spindle and a rotatable supporting sleeve on the spindle wherein the bobbin sleeve is slidably positioned over the supporting sleeve.

6. Bobbin pallets for a weaving device for facilitating changing of bobbins without interruption or disturbance to warp thread tension in weaving zones of the weaving device, each bobbin pallet comprising support means for supporting and/or holding one bobbin sleeve, one throughput eye for guiding a thread, and one thread brake, wherein each pallet comprises a holder at one end, a vertical projection on the holder, a thread clip on the projection for presenting a thread end at specified locations, a horizontal portion for carrying the throughput eye and the thread brake such that the throughput eye is in the axis of the bobbin and a leaf spring on the thread clip for presenting the thread end at the specified locations.

* * * * *